US005247823A

United States Patent [19]

Rossi

[11] Patent Number: 5,247,823

[45] Date of Patent: Sep. 28, 1993

[54] SELF-ADJUSTING MULTISTAGE WIREDRAWING MACHINE

[75] Inventor: Attilio Rossi, Legnano, Italy

[73] Assignee: Redaelli Tecna Meccanica S.p.Al, Milan, Italy

[21] Appl. No.: 881,700

[22] Filed: May 12, 1992

[30] Foreign Application Priority Data

Jun. 7, 1991 [IT] Italy ..... MI91A001584

[51] Int. Cl.[5] ..... B21C 1/10; B21C 1/12

[52] U.S. Cl. ..... 72/279; 72/280; 72/288; 72/289; 242/47.01

[58] Field of Search ..... 72/280, 279, 288, 289; 242/47.01, 47.08, 47.09, 45, 78; 226/108, 188

[56] References Cited

U.S. PATENT DOCUMENTS

| | | | |
|---|---|---|---|
| 2,162,357 | 6/1939 | Pierce | 72/289 |
| 2,179,348 | 11/1939 | Penney | 72/280 |
| 2,252,352 | 8/1941 | Pierce | 72/280 |
| 2,986,353 | 5/1961 | McCoy | 242/45 |

FOREIGN PATENT DOCUMENTS

| | | | |
|---|---|---|---|
| 218971 | 11/1924 | United Kingdom | 72/288 |

*Primary Examiner*—Daniel C. Crane

*Attorney, Agent, or Firm*—Stevens, Davis, Miller & Mosher

[57] ABSTRACT

A wiredrawing machine is composed of a plurality of stages in cascade, each stage comprising a die (13) through which passes the wire (14) which is partially wound around a motor-driven tension pulley (12). The tension pulley (12) is kinematically connected to a gear wheel (21) which meshes with a pinion (20) supported by a lever (23) to enable it to rotate around the outer edge of the gear wheel (21). Keyed onto the pinion (20) is a first pulley (19) around which winds a section of a belt (18) driven by a second expanding pulley (17) driven by a motor (16). The lever (23) is connected to spring members (24) which rotate the pinion (20) around the gear wheel (21) in a direction in which it tightens the belt (18).

4 Claims, 1 Drawing Sheet

SELF-ADJUSTING MULTISTAGE WIREDRAWING MACHINE

This invention refers to a direct-pull multiple wiredrawing machine.

There are known multiple wiredrawing machines in which the wire to be drawn is pulled through consecutive dies with decreasing cross sections. To enable them to operate efficiently, the ratio between the section and the speed of the wire must be a constant so as not to subject the wire to stress which would cause it to snap.

Consequently, the section of the wire between two dies is generally wound around rollers made to rotate by electric motors which are accurately controlled in speed in order to apply the appropriate degree of tension to that section of the wire.

To ensure that the tractive conditions are continuously maintained, thereby making it possible to work without interruption even when the section of the wire varies due to the wearing out of the drawing tool, some time ago it was suggested fitting sensors, generally known as feeler pins, in the sections of wire between the dies, upon which the tension of the wire acts. The angular movement of these sensors is converted into electric signals which control devices governing the speed of the electric motors.

Due to the need for precise speed control, the electric motors are direct current motors or induction motors powered by frequency converters.

This, however, necessarily calls for the use of a complex assembly of mechanical and electronic parts, resulting in high manufacturing costs, and the increased likelihood of breakdowns and need for costly servicing and repairs.

Moreover, in the event of sudden power drops, the momentary lack of balance in the traction exerted by the various motors causes the wire to snap.

Another type of known wiredrawing machine, normally used for medium to thick wire, comprises a regulating device which makes use of the tractive force transmitted by the wire between the subsequent groups of motors.

In this embodiment, the motors are first adjusted (by hand or by means of automatic or semiautomatic devices) to generate a torque slightly smaller than the torque required to start up the wiredrawing. Whereupon, the last motor of the wiredrawing machine is adjusted to exert traction on the wire which enables the motor directly preceding it to rotate and thus in turn exert traction which is transmitted to the preceding motor, and so on until the entire wire mill is set in motion.

It is obvious that this type of wiredrawing machine can only be used for drawing wires which ar thick enough to withstand the tractive forces generated during the transient periods, when there are suddenly increases in the traction between the rollers due to inertia of the mechanical elements or delayed response of the electrical control devices.

Accumulative type wiredrawing machines have also been proposed, which do not comprise speed regulating devices and the quantity drawn from one die is greater than the quantity drawn from the subsequent die so as to prevent the transmission of harmful tractive stress between the various stages of the machine. The wire between the dies is consequently accumulated in special structures, inevitably causing twists and bends in the wire.

Moreover, when the wire is withdrawn from the accumulation structures it may be subjected to excessive and totally uncontrolled tractive stress. All this stress is extremely harmful because it is liable to cause hidden flaws or microcracks in the material or, at the worst, cause the wire to snap at the point of welding.

The general scope of this invention is to obviate the aforementioned problems by providing a multistage wiredrawing machine with an original system for controlling the speed and tension of the wire in process, which very simply and inexpensively automatically adjusts the speed at which the wire runs between subsequent stages.

This scope is achieved, according to the invention, by providing a wiredrawing machine composed of a plurality of stages in cascade, each stage comprising a die through which passes the wire partially wound around a motor-driven tension pulley, characterized by the fact that the tension pulley is kinematically connected to a gear wheel meshing with a pinion, said pinion being supported by moving means to enable it to rotate around the outer edge of the gear wheel and bearing a first pulley around which is wound a section of a belt driven by a second motor-driven expanding pulley whose diameter varies according to the tension of the belt, the moving means comprising spring members which rotate the pinion around the gear wheel in the direction in which it tightens the belt.

The innovatory principles of this invention and its advantages with respect to the known technique will be more clearly evident from the following description of a possible exemplificative embodiment applying such principles, with reference to the accompanying drawings, in which.

Figure 1:
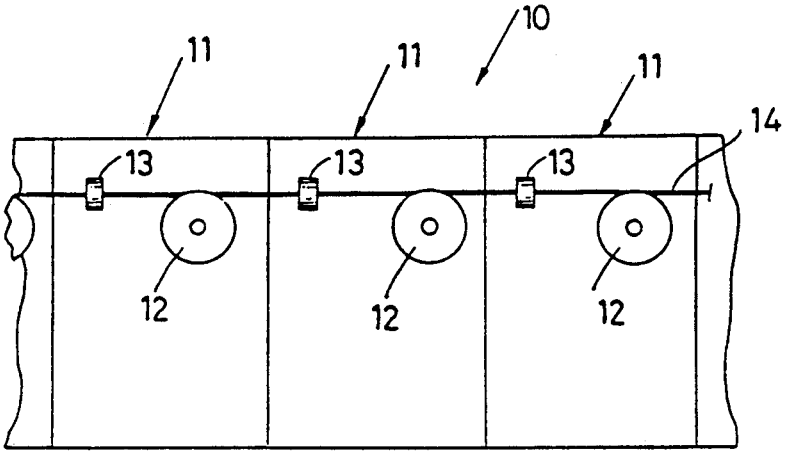
FIG. 1 shows a partial schematic front view of a multistage wiredrawing machine, according to the invention.

With reference to the figures, a wiredrawing machine, generically indicated by reference 10, is composed of a plurality of stages 11 disposed in sequence for drawing a wire 14. Each stage 11 comprises a tension pulley 12 around which the wire winds and is then pulled through a die 13. As is usual in multistage wiredrawing mills, the dies progressively decrease in diameter so as to gradually reduce the wire to the desired diameter.

Figure 2:
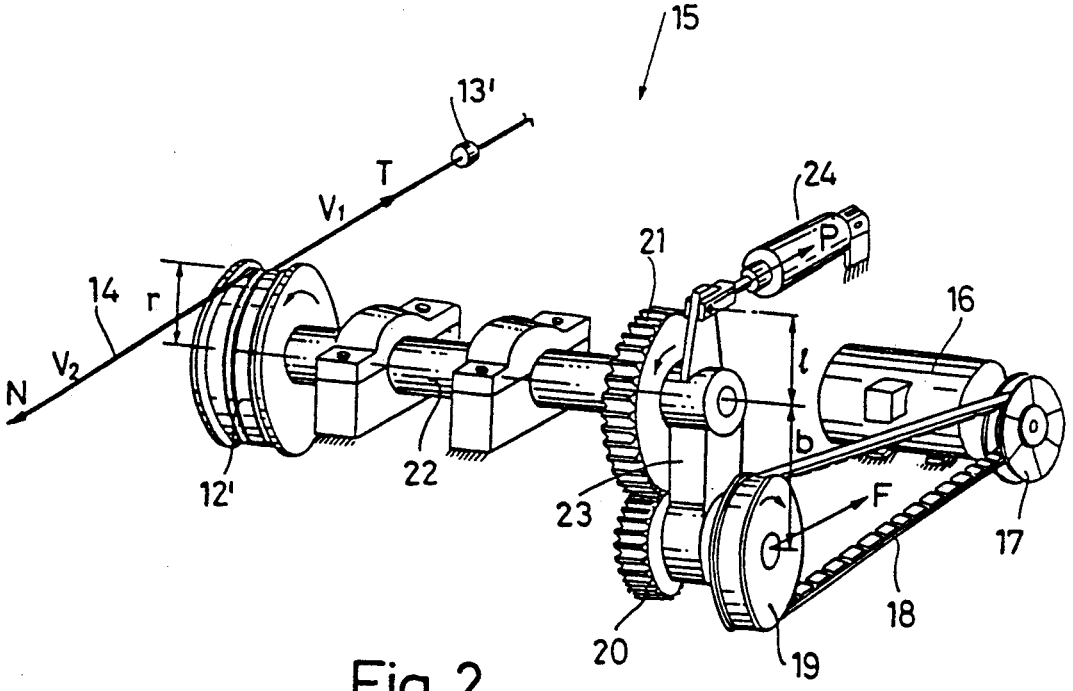
FIG. 2 shows a schematic perspective view of a drive mechanism of one stage of the machine of FIG. 1.

FIG. 2 schematically shows a kinematic mechanism 15 for transmission of movement between a tension pulley and an electric motor 16. This kinematic mechanism is substantially identical for each stage 11 and will therefore be described with reference to a generic stage 11, with tension pulley 12' and die 13'.

As shown in FIG. 2, keyed onto the shaft of the motor 16 is a known type of expanding pulley 17 around which winds a belt 18 which drives a normal pulley 19. The two lateral shoulders of the expanding pulley 17 slope in a substantially radial direction and are biased towards each other by a spring. As the tension on the belt increases, the belt, overcoming the reaction of the spring, wedges itself between the lateral shoulders of the pulley and shifts towards the axis, thereby increasing the velocity ratio between the pulley 17 and the pulley 19. The expanding pulley is well known to the technician and consequently will not be further shown nor described herein.

The pulley 19 is coaxially and integrally connected to a pinion 20 meshing with a gear wheel 21 keyed onto a shaft 22 to which the pulley 12' is also integrally connected. The pulley 19 and the pinion 20 are rotatingly supported by a lever 23 freely coaxially supported by the shaft 22 in an intermediate position and opposingly connected to a spring device 24 such as, for example, an air-operated spring or the like.

Substantially, in the static condition, the arm 23 is subjected on one side to a force F due to the action of the springs of the expanding pulley, and on the other to an opposing force P due to the traction exerted by the spring 24. The lever is of such dimensions that the moment of the arm "1" by the force P totally or partially balances out the moment produced by the arm "b" by the force F.

When the wire 14 is positioned and the motor 16 is switched on., the pinion 20, due to the rotatory motion transmitted to it by the motor, tends to roll around the outer edge of the gear wheel 21 which is controlled by a torque produced by the arm "r" of the pulley 12' by the force T, which is the force required to draw, that is, to pull the wire 14 through the die 13'.

The pinion 20 consequently rolls around the gear wheel 21 (in a clockwise direction in FIG. 2}and this rotation tightens the belt 18 which becomes wedged further into the expanding pulley 17, thereby increasing the transmission ratio between the two pulleys 17, 19.

This gives rise to an increase in the torque transmitted to the shaft 22 of the tension pulley 12'.

When the torque transmitted by the motor 16 exceeds the torque $r \times T$ (working torque), the gear wheel 21 begins to rotate and with it the tension pulley 12'. At this point the lever 23 gradually reaches a point of equilibrium due to the various torques acting on it and stops moving in an angular direction. The drawplate 11 thus comes into operation to pull the wire through the die 13' with a force T and at a speed V1.

After having passed through the die and wound a few times around the pulley 12' of the stage 11 in question, the wire goes on to the next stage at a speed V2. It is thus possible to obtain different conditions due to the proportions between V1 and V2.

When $V2=V1$ no slippage occurs on the pulley 12' and the working conditions are ideal.

Conversely, $V2>V1$ gives rise to a condition which calls for adjustment in order to prevent the wire from snapping; adjustment which in the known technique is obtained by means of the aforementioned devices and with the aforementioned disadvantages and defects.

The higher speed in the section of the wire winding off the tension pulley gives rise to a torque $N \times r$, where N is the counterpull which is generated on the outcoming section of wire. The value of the counterpull N must be kept below the ultimate tensile stress of the material in process.

In the machine according to the invention, the torque $N \times r$ causes an increase in the speed of rotation of the tension pulley 12' and, consequently, of the gear wheel 21. This causes the pinion 20 to move around the gear wheel 21 in the direction of rotation of the gear wheel 21 to reach a new position of equilibrium. As a result, the center distance between the pulleys 19 and 17 is reduced and the belt 18 is thrust towards the outer edge of the expanding pulley 17. The decrease in velocity ratio thus caused gives rise to an increase in the speed of the tension pulley 12', synchronizing it with the speed V2, thus bringing it to $V1=V2$.

When $V2<V1$, the wire on the tension pulley 12' slackens, resulting in the slippage of the wire on the surface of the pulley.

In this case, the self-adjustment process described above for $V2>V1$ comes into operation again. When the mechanical elements are appropriately dimensioned, this process occurs before the wire bas slackened on the tension pulley to such a degree as to cause it to slip. The increase in tension torque required on the gear wheel 21 and due to the decreased counterpull N, causes the pinion 20 to rotate around the edge of the gear wheel 21 in the opposite direction to the direction of rotation of the latter to reach a new position of equilibrium. The increased center distance between the pulleys 17 and 19 causes the belt 18 to become wedged further in between the shoulders of the expanding pulley 17 which gives rise to an increase in the velocity ratio, and a consequent decrease in the speed of the tension pulley which once again becomes synchronized with the speed V2.

In substance, the speed of rotation of the tension pulley is a function of the working torque which is given by the working pull of the wire passing through the die 13' by the arm r modified by the counterpull N also by the arm r. Mathematically, the equilibrium of the resulting torques in the system, in order to keep the lever 23 stationary is:

$$(F \times b)-(P \times 1)=((T-N) \times r)$$

It is clear, therefore, that by suitably defining the mechanical dimensions of the elements of the mechanism 15 and then adjusting the force P of the spring 24, it is possible to control the N value, so as to maintain it within a range lower than the value of the ultimate tensile strength of the wire.

At this point, the cascade operation of stages 11, each provided with the self-adjusting device 15, will be clear to the technician.

All the stages of the wiredrawing machine will tend to remain synchronized with the wire speed set by the subsequent stage. The last stage consequently acts as a driver stage and sets the wire speeds in the various wiredrawing stages, which automatically adjust themselves in cascade.

It is obvious, therefore, that the motors do not require sophisticated electronic speed control devices or sensors to detect the tension of the wire in the various stages. Consequently, the embodiment of a multistage wire mill can be achieved by simply placing the various stages in cascade without the need for electrical connections between them other than those supplying power to the motors, which can be of any type whatsoever and therefore even normal inexpensive three-phase induction motors. Moreover, it should be borne in mind that, during start up, whenever the torque transmitted by the motor exceeds the working torque, due to rotation of the lever 23, the gear wheel 21 begins to rotate gradually, thereby preventing sudden and excessive tension on the wire.

The foregoing description of an embodiment applying the innovatory principles of this invention is obviously given by way of example in order to illustrate such innovatory principles and should not therefore be understood as a limitation to the sphere of the invention claimed herein.

For example, the wiredrawing machine has been described and shown paying special attention to the innovatory elements claimed herein. It will be obvious to the technician that the aforesaid machine can be provided with numerous known devices normally used in drawing mills which are neither shown nor described herein, since they are easily imaginable by experts in the field. For example, the drawplates can be provided with further guide rollers along the path of the wire as well as break sensors for automatically switching off the motors.

Moreover, a further known drive could be inserted between the gear wheel 21 and tension pulley 12'. The lever 23 can also be shaped differently from the one shown, obviously shifting the points and directions of application of the forces compared to the position of previously chosen fulcrum. Lastly, the spring 24, can be of any known type. For example, it could advantageously be a fluid-operated spring in which the force exerted is easily adjustable by means of a known external circuit supplying fluid under pressure.

I claim:

1. A wiredrawing machine composed of a plurality of stages in cascade, each stage comprising a die through which the wire passes and a drawing means for said wire, said drawing means comprising a tension pulley around which said wire passes, a first means upon which said tension pulley is mounted, a gear wheel mounted on said first means, a moving second means rotatably mounted on said first means carrying a pinion rotatable around the outer edge of said gear and meshing therewith, a first pulley rotatable with said pinion, a fixed motor, an expanding second pulley driven about an axis by said motor and distanced from said first pulley and a belt mounted on said first and second pulleys, said expanding second pulley permitting the belt to move towards and away from said axis, and spring members biasing said pinion to increase the distance between said first and second pulleys so that when torque is varied on said tension pulley by the wire, the belt will move towards or away from the axis of the expanding second pulley thereby varying the speed of the first pulley.

2. The wiredrawing machine of claim 1, wherein said moving second means includes a lever having two ends and rotatably mounted on said first means intermediate its ends, said pinion being mounted on one of its ends.

3. The wiredrawing machine of claim 2 wherein said spring means are connected to the other of said ends.

4. The wiredrawing machine of claim 1 wherein said spring members comprise a fluid operated spring.

* * * * *